US006738017B2

(12) United States Patent
Jacomb-Hood

(10) Patent No.: US 6,738,017 B2
(45) Date of Patent: May 18, 2004

(54) MODULAR PHASED ARRAY WITH IMPROVED BEAM-TO-BEAM ISOLATION

(75) Inventor: Anthony W. Jacomb-Hood, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 27 days.

(21) Appl. No.: 10/212,229

(22) Filed: Aug. 6, 2002

(65) Prior Publication Data

US 2004/0027279 A1 Feb. 12, 2004

(51) Int. Cl.[7] ..... H01Q 3/24; H01Q 3/26

(52) U.S. Cl. ..... 342/368; 342/373

(58) Field of Search ..... 342/372, 373, 342/374, 368

(56) References Cited

U.S. PATENT DOCUMENTS

| | | | |
|---|---|---|---|
| 2,786,133 | A | 3/1957 | Dyke |
| 2,951,152 | A | 8/1960 | Sichak et al. |
| 4,885,589 | A | 12/1989 | Edward et al. |
| 4,939,527 | A | 7/1990 | Lamberty et al. |
| 5,017,927 | A | 5/1991 | Agrawal et al. |
| 5,291,475 | A | 3/1994 | Bruckert |
| 5,345,603 | A | 9/1994 | Laffont |
| 5,394,561 | A | 2/1995 | Freeburg |
| 5,459,474 | A | 10/1995 | Mattioli et al. |
| 5,572,219 | A | 11/1996 | Silverstein et al. |
| 5,663,736 | A | 9/1997 | Webb et al. |
| 5,666,128 | A | 9/1997 | Murray et al. |
| 5,675,343 | A | 10/1997 | Champeau |
| 5,708,969 | A | 1/1998 | Kotzin et al. |
| 5,734,983 | A | 3/1998 | Faruque |
| 5,740,536 | A | 4/1998 | Benveniste |
| 5,768,266 | A | 6/1998 | Thompson et al. |
| 5,790,070 | A | 8/1998 | Natarajan et al. |
| 5,790,071 | A | 8/1998 | Silverstein et al. |
| 5,870,063 | A | 2/1999 | Cherrette et al. |

(List continued on next page.)

FOREIGN PATENT DOCUMENTS

| | | |
|---|---|---|
| EP | 0 276 817 A2 | 1/1988 |
| EP | 0 798 209 A2 | 3/1997 |
| GB | 2251360 | 7/1992 |
| JP | 0248124 | 10/1990 |
| WO | WO 00/07307 A2 | 2/2000 |

OTHER PUBLICATIONS

Hall, P.S. et al., Review of Radio Frequency Beamforming Techniques for Scanned and Multiple Beam Antennas, IEEE Proceedings Part H., Oct. 1, 1990, pp. 293–303, vol. 137, No. 5.

Kilgus, Dr. C.C., Spacecraft and Ground Station Applications of the Resonant Quadrifilar Helix, IEEE International Conference, 1974, pp. 75–77.

Kilgus, Dr. C.C., Resonant Quadrifilar Helix Design, The Microwave Journal, Dec. 1970, pp. 49–54.

*Primary Examiner*—Thomas H. Tarcza
*Assistant Examiner*—F H Mull
(74) *Attorney, Agent, or Firm*—Townsend and Townsend and Crew LLP

(57) ABSTRACT

A modular phased array antenna provides a reduction in the error signals that are introduced into beam signals by electromagnetic coupling that is inexpensive and does not cause an increase in weight or in power consumption. A modular phased array antenna has irregular or random connections of beam signals to beam ports of each modular antenna assembly so as to provide improved beam-to-beam isolation. A modular phased array antenna comprises a plurality of modular antenna assemblies, each modular antenna assembly having a plurality of beam ports, each beam port of a modular antenna assembly connected to a different beam signal, wherein the beam signals are irregularly connected to the beam ports relative to the modular antenna assemblies. The beam signals may be randomly connected to the beam ports relative to the modular antenna assemblies.

37 Claims, 7 Drawing Sheets

U.S. PATENT DOCUMENTS 5,927,654 A 7/1999 Foley et al.
6,002,360 A 12/1999 Wolcott et al.
6,014,372 A 1/2000 Kent et al.
6,043,776 A 3/2000 Chiba et al.
6,084,545 A 7/2000 Lier et al.
6,112,094 A 8/2000 Dent
6,131,022 A 10/2000 Jacomb-Hood et al.
6,157,621 A 12/2000 Brown et al.
6,163,296 A 12/2000 Lier et al.
6,172,655 B1 1/2001 Volman
6,232,920 B1 5/2001 Brookner et al.
6,239,762 B1 5/2001 Lier
6,246,364 B1 6/2001 Rao et al.
6,362,780 B1 3/2002 Butz et al.
6,366,238 B1 4/2002 DeMore et al.
6,377,561 B1 4/2002 Black et al.
6,407,722 B1 6/2002 Bogner et al.
6,411,256 B1 6/2002 Lier et al.
6,438,354 B2 8/2002 Thompson et al.
6,507,315 B2 1/2003 Purdy et al.
6,522,643 B1 2/2003 Jacomb-Hood et al.
2002/0171585 A1 11/2002 Eiges

MODULAR PHASED ARRAY WITH IMPROVED BEAM-TO-BEAM ISOLATION

FIELD OF THE INVENTION

The present invention relates to a modular phased array antenna having irregular or random connections of beam signals to beam ports of each modular antenna assembly so as to provide improved beam-to-beam isolation.

BACKGROUND OF THE INVENTION

The costs of communications spacecraft are under downward pressures due to competition among spacecraft manufacturers, and also due to competition with other forms of communications. One way to reduce the cost of a communications spacecraft is the use of modularized spacecraft techniques. For example, U.S. Pat. No. 5,666,128 to Murray, et al., describes the use of array antennas that are modular, so that a spacecraft may have its antennas made up of standard subarrays mounted in a standardized structure. Likewise, U.S. Pat. No. 5,870,063 to Cherrette, et al., describes a spacecraft having antennas that are constructed with modular elements, for ready interchangeability and configuring.

A typical modular phased array antenna includes a number of antenna array modules or building blocks radiating a number of signal beams. Each beam signal is processed by beam specific electronics, then input to each antenna array module. In a traditional design, each beam is input to the same input port of each antenna array module. A problem arises with this design due to electromagnetic coupling among the paths within the antenna array module. In particular, electromagnetic coupling among the circuit paths of an antenna array module cause coupling of the beam signal on each circuit path to the circuit paths of every other beam signal in the antenna array module. This coupling effect is typically dependent upon the geometry and layout of the circuit paths in the antenna array module, with (in general) greater coupling occurring among circuit paths that are physically closer to each other and that are parallel to each other. A signal that is introduced due to electromagnetic coupling may be seen as an error signal introduced into the intended signal.

Due to the regular geometry of antenna array modules, the coupling of beam signals will tend to correlate from module to module. Since the antenna array modules are typically mass-produced, the coupling among signals in each antenna array module will be similar. Thus, the magnitude and phase of the coupling is repeatable from module to module. These correlated, coupled signals reinforce each other and produce a much greater error signal in each beam than would be produced by any one uncorrelated signal. The beam pattern for each beam signal will be the vector sum of the intended beam pattern for the beam signal and the intended beam pattern for each other beam signal path that receives power from the first beam signal by unintended coupling, attenuated by the isolation of the coupling path. Each coupled error signal will create a sidelobe in the beam pattern of the beam associated with that signal in the direction of the mainlobe of the intended beam pattern of the beam into which the signal has coupled. This may cause unacceptable interference.

While the magnitude of the coupled error signals may be reduced by increasing the isolation of the coupling paths, this is an expensive and weight-increasing solution. What is needed is a technique by which the error signals that are introduced into beam signals by electromagnetic coupling may be reduced without resorting to expensive and weight-increasing solutions.

SUMMARY OF THE INVENTION

The present invention is a modular phased array antenna that provides a reduction in the error signals that are introduced into beam signals by electromagnetic coupling. The invention is inexpensive to implement and does not cause an increase in weight or power consumption. The modular phased array antenna has irregular or random connections of beam signals to beam ports of each modular antenna assembly so as to provide improved beam-to-beam isolation.

In one embodiment of the present invention, a modular phased array antenna comprises a plurality of modular antenna assemblies, each modular antenna assembly having a plurality of beam ports, each beam port of a modular antenna assembly connected to a different beam signal, wherein the beam signals are irregularly connected to the beam ports relative to the modular antenna assemblies. The beam signals may be randomly connected to the beam ports relative to the modular antenna assemblies. The beam signals may be connected to the beam ports relative to the modular antenna assemblies so that vector sums of coupling coefficients of beam signal to beamformer paths is reduced compared to a regular connection of the beam signals to the beam ports relative to the modular antenna assemblies. The beam signals may be connected to the beam ports relative to the modular antenna assemblies so that vector sums of coupling coefficients of beam signal to beamformer paths is minimized.

In one embodiment of the present invention, the modular phased array antenna is a receiving antenna, which may comprise a plurality of modular antenna assemblies. Each modular antenna assembly may comprise a plurality of power combiners, each power combiner having an output connected to a beam port of the modular antenna assembly, and each power combiner having a plurality of inputs, a plurality of phase shift attenuators, each phase shift attenuator having an output connected to an input of a power combiner, and each phase shift attenuator having an input, a plurality of power dividers, each power divider having a plurality of outputs, each output connected to an input of a phase shift attenuator, and each power divider having an input, a plurality of amplifiers, each amplifier having an output connected to an input of a power divider, and each amplifier having an input, and a plurality of antenna elements, each antenna element having an output connected to an input of an amplifier.

In one aspect of the present invention, the modular phased array antenna may further comprise a plurality of driver amplifiers, each driver amplifier connected between a beam port of the modular antenna assembly and a power combiner output, each driver amplifier having an input connected to a power combiner output and having an output connected to a beam port.

In one aspect of the present invention, the modular phased array antenna may further comprise a plurality of power combiners, each power combiner having an output connected to a beam signal and having a plurality of inputs inputting the beam signal, each of the plurality of inputs connected to a beam port of a modular antenna assembly. The connections of the beam signals to the beam ports of the modular antenna assemblies may be randomly assigned. The connections of the beam signals to the beam ports of the modular antenna assemblies may be assigned so that vector sums of coupling coefficients of beam signal to beamformer paths is reduced compared to a regular connection of the beam signals to the beam ports relative to the modular antenna assemblies. The connections of the beam signals to the beam ports of the modular antenna assemblies may be assigned so that vector sums of coupling coefficients of beam signal to beamformer paths is minimized. The connections of the beam signals to the beam ports of the modular antenna assemblies may be hard-wired. The connections of the beam signals to the beam ports of the modular antenna assemblies may be provided by at least one of fiber optic cable, coaxial cable, or printed circuit board traces. The connections of the beam signals to the beam ports of the modular antenna assemblies may be configurable in software. The connections of the beam signals to the beam ports of the modular antenna assemblies may be provided by a switching matrix or other programmable connection device.

In one embodiment of the present invention, the modular phased array antenna is a transmitting antenna, which may comprise a plurality of modular antenna assemblies. Each modular antenna assembly may comprise a plurality of power dividers, each power divider having an input connected to a beam port of the modular antenna assembly, and each power divider having a plurality of outputs, a plurality of phase shift attenuators, each phase shift attenuator having an input connected to an output of a power divider, and each phase shift attenuator having an output, a plurality of power combiners, each power combiner having a plurality of inputs, each input connected to an output of a phase shift attenuator, and each power combiner having an output, a plurality of amplifiers, each amplifier having an input connected to an output of a power combiner, and each amplifier having an output, and a plurality of antenna elements, each antenna element having an input connected to an output of an amplifier.

In one aspect of the present invention, the modular phased array antenna may further comprise a plurality of driver amplifiers, each driver amplifier connected between a beam port of the modular antenna assembly and a power divider input, each driver amplifier having an input connected to a beam port and having an output connected to a power divider input.

In one aspect of the present invention, the modular phased array antenna may further comprise a plurality of power dividers, each power divider having an input connected to a beam signal and having a plurality of outputs outputting the beam signal, each of the plurality of outputs connected to a beam port of a modular antenna assembly. The connections of the beam signals to the beam ports of the modular antenna assemblies may be randomly assigned. The connections of the beam signals to the beam ports of the modular antenna assemblies may be assigned so that vector sums of coupling coefficients of beam signal to beamformer paths is reduced compared to a regular connection of the beam signals to the beam ports relative to the modular antenna assemblies. The connections of the beam signals to the beam ports of the modular antenna assemblies may be assigned so that vector sums of coupling coefficients of beam signal to beamformer paths is minimized. The connections of the beam signals to the beam ports of the modular antenna assemblies may be hard-wired. The connections of the beam signals to the beam ports of the modular antenna assemblies may be provided by at least one of fiber optic cable, coaxial cable, or printed circuit board traces. The connections of the beam signals to the beam ports of the modular antenna assemblies may be configurable in software. The connections of the beam signals to the beam ports of the modular antenna assemblies may be provided by a switching matrix or other programmable connection device.

In one embodiment of the present invention, the modular phased array antenna is a transmitting and receiving antenna, which may comprise a plurality of modular antenna assemblies. Each modular antenna assembly may comprise a plurality of first power dividers/combiners, each first power divider/combiner having a first input/output connected to a beam port of the modular antenna assembly, and each first power divider/combiner having a plurality of second outputs/inputs, a plurality of phase shift attenuators, each phase shift attenuator having a first input/output connected to a second output/input of a first power divider/combiner, and each phase shift attenuator having a second output/input, a plurality of second power combiners/dividers, each second power combiner/divider having a plurality of first inputs/outputs, each first input/output connected to a second output/input of a phase shift attenuator, and each second power combiner/divider having a second output/input, a plurality of duplexed amplifier pairs, each duplexed amplifier pair comprising a first amplifier and a second amplifier connected between a pair of duplexers, each duplexed amplifier pair having a first input/output connected to second output/input of a second power combiner/divider, and each amplifier having second output/input, and a plurality of antenna elements, each antenna element having an input/output connected to a second output/input of a duplexed amplifier pair.

In one aspect of the present invention, the modular phased array antenna may further comprise a plurality of duplexed driver amplifier pairs, each duplexed driver amplifier pair connected between a beam port of the modular antenna assembly and a power divider/combiner input/output, each duplexed amplifier pair comprising a first driver amplifier and a second driver amplifier connected between a pair of duplexers, each duplexed driver amplifier pair having a first input/output connected to a beam port of the modular antenna assembly, and having a second output/input connected to a power divider/combiner input/output.

In one aspect of the present invention, the modular phased array antenna may further comprise a plurality of third power dividers/combiners, each third power divider/combiner having a first input/output connected to a beam signal and having a plurality of second outputs/inputs connected to a beam port of a modular antenna assembly. The connections of the beam signals to the beam ports of the modular antenna assemblies may be randomly assigned. The connections of the beam signals to the beam ports of the modular antenna assemblies may be assigned so that vector sums of coupling coefficients of beam signal to beamformer paths is reduced compared to a regular connection of the beam signals to the beam ports relative to the modular antenna assemblies. The connections of the beam signals to the beam ports of the modular antenna assemblies may be assigned so that vector sums of coupling coefficients of beam signal to beamformer paths is minimized. The connections of the beam signals to the beam ports of the modular antenna assemblies may be hard-wired. The connections of the beam signals to the beam ports of the modular antenna assemblies may be provided by at least one of fiber optic cable, coaxial cable, or printed circuit board traces. The connections of the beam signals to the beam ports of the modular antenna assemblies may be configurable in software. The connections of the beam signals to the beam ports of the modular antenna assemblies may be provided by a switching matrix or other programmable connection device.

BRIEF DESCRIPTION OF THE DRAWINGS

The details of the present invention, both as to its structure and operation, can best be understood by referring to the accompanying drawings, in which like reference numbers and designations refer to like elements.

DETAILED DESCRIPTION OF THE INVENTION

The present invention is a modular phased array antenna that provides a reduction in the error signals that are introduced into beam signals by electromagnetic coupling. The invention is inexpensive to implement and does not cause an increase in weight or power consumption. The modular phased array antenna has irregular or random connections of beam signals to beam ports of each modular antenna assembly so as to provide improved beam-to-beam isolation.

Figure 1:
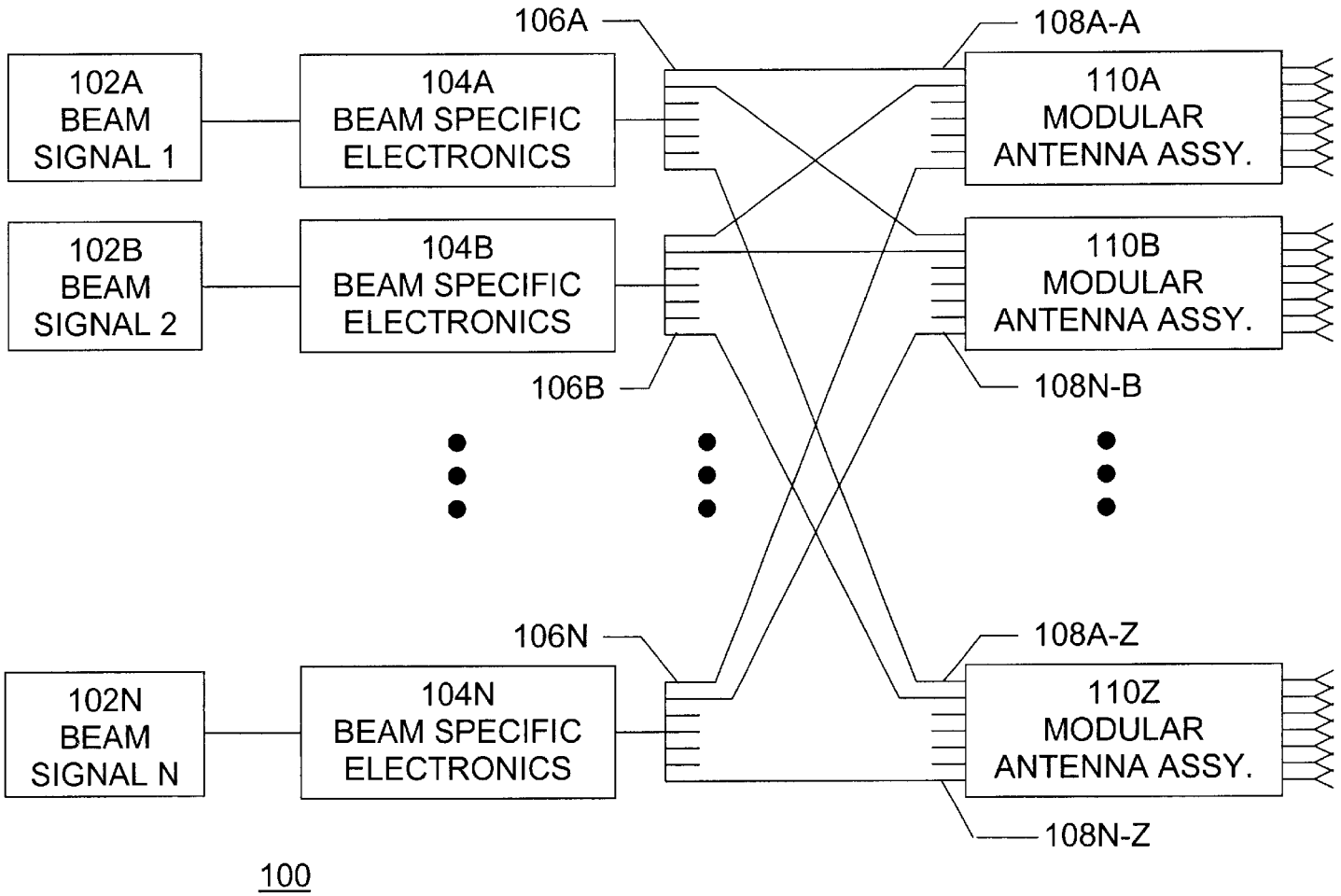
Fig. 1 PRIOR ART
FIG. 1 is an exemplary block diagram of a typical prior art modular phased array antenna.

An exemplary block diagram of a typical prior art modular phased array antenna 100 is shown in FIG. 1. Modular phased array antenna 100 creates a plurality of beams. Each, beam is associated with a, signal such as beam signals 102A–N. Typically different signals are connected to each of the beam ports. Each of these signals are intended to be directed in a particular direction by modular phased array antenna 100. In an embodiment in which modular phased array antenna 100 is a transmitting antenna, each beam is radiated in a particular direction. In an embodiment in which modular phased array antenna 100 is a receiving antenna, each beam is received from a particular direction.

Each beam signal is processed by beam specific electronics. For example, beam signal 102A is processed by beam specific electronics 104A, beam signal 102B is processed by beam specific electronics 104B, etc. In an embodiment in which modular phased array antenna 100 is a transmitting antenna, each beam signal is input to beam specific electronics. In an embodiment in which modular phased array antenna 100 is a receiving antenna, each beam signal is output from beam specific electronics. Beam specific electronics includes functions such as amplification/attenuation, frequency conversion and filtering.

The beam specific electronics 104A–N is connected to power dividers/combiners 106A–N, which are connected to modular antenna assemblies 110A–Z via beam ports 108AA–NZ. In an embodiment in which modular phased array antenna 100 is a transmitting antenna, each beam signal that is output from the beam specific electronics is divided by a power divider having one output connected to one beam port of each modular antenna assembly. Each power divider output is connected to the same input beam port of each modular antenna assembly. Thus, in the example shown in FIG. 1, each output from power divider 106A is connected to the first input beam port 108AA–AZ of each modular antenna assembly 110A–Z, each output from power divider 106B is connected to the second input beam port 108BA–BZ of each modular antenna assembly, etc.

In an embodiment in which modular phased array antenna 100 is a receiving antenna, each beam signal that is input to the beam specific electronics is output from a power combiner having one input connected to one beam port of each modular antenna assembly. Each power combiner input is connected to the same output beam port of each modular antenna assembly. Thus, in the example shown in FIG. 1, each input to power combiner 106A is connected to the first output beam port 108AA–AZ of each modular antenna assembly 110A–Z, each input to power combiner 106B is connected to the second output beam port 108BA–BZ of each modular antenna assembly, etc.

Figure 2:
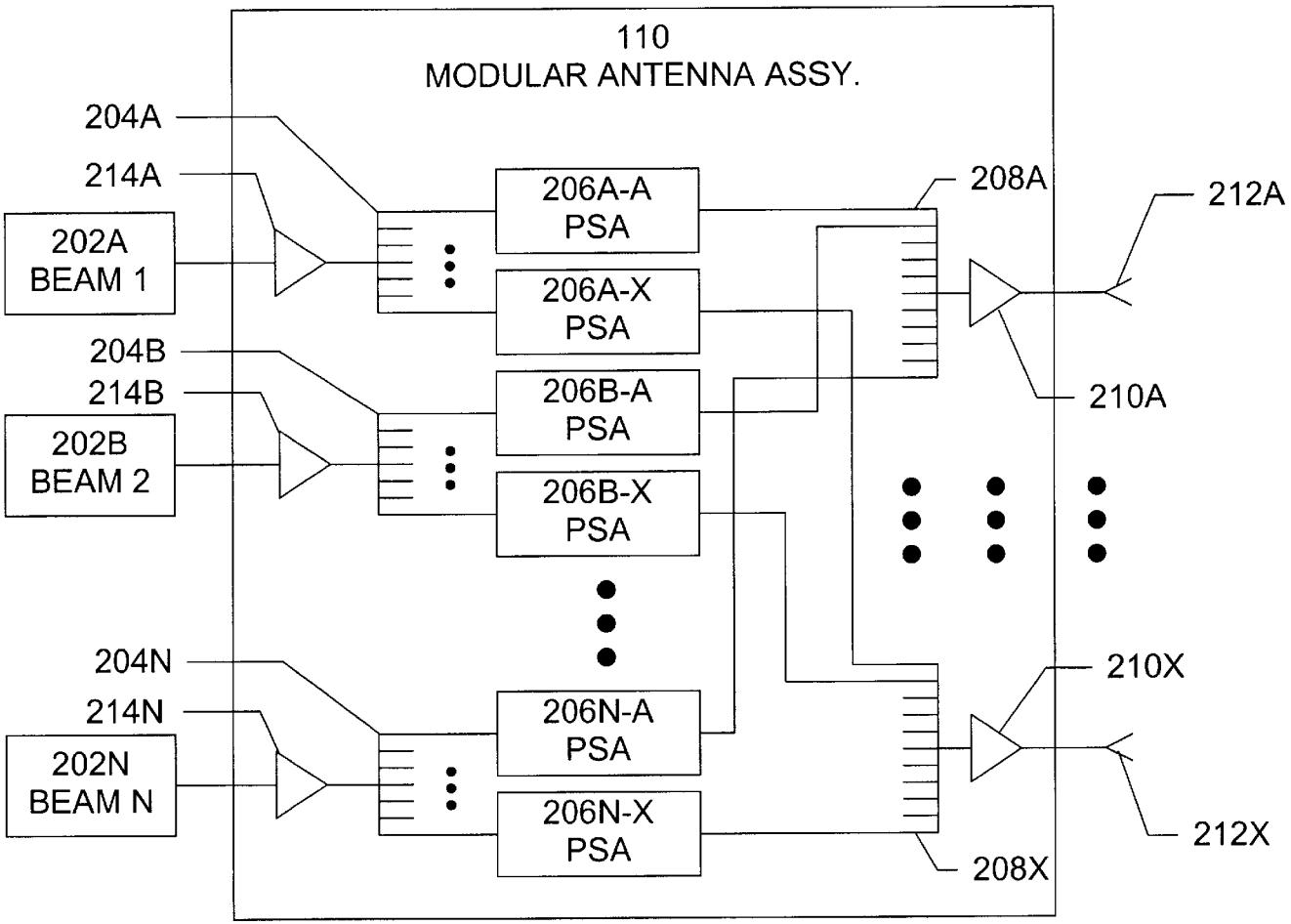
Fig. 2 PRIOR ART
FIG. 2 is an exemplary block diagram of a modular antenna assembly, shown in FIG. 1.

An exemplary block diagram of a modular antenna assembly 110, such as is shown in FIG. 1, is shown in FIG. 2. In the example shown in FIG. 2, modular antenna assembly 110 is a transmitting embodiment. Modular antenna assembly includes a plurality of input beam ports 202A–N, a plurality of driver amplifiers 214A–N, a plurality of power dividers 204A–N, a plurality of phase shift attenuators 206A–A to 206N–X, a plurality of power combiners 208A–X, a plurality of power amplifiers 210A–X, and a plurality of antenna elements 212A–X.

Each input beam port 202A–N is connected to the input to a driver amplifier 214A–N, which amplifies the signal and outputs the amplified signal to the input to a power divider 204A–N. Each power divider 204A–N divides the input signal into a plurality of signals of nominally equal power, which are output from the plurality of outputs of power dividers 204A–N. Each output of each power divider 204A–N is connected to the input of a corresponding phase shifter attenuator 206A–A to 206N–X. Each phase shifter attenuator shifts its input signal by a predetermined phase angle and attenuates the input signal by a predetermined amount. The phase angles and attenuation amounts may be different for each phase shifter attenuator 206A–A to 206N–X. Phase shifter attenuators 206A–A to 206N–X are used to electronically steer and shape the beams created by the antenna array. A beam may be pointed in different directions by resetting the phase shifts of all of the phase shifters associated with that beam.

The output of each phase shifter attenuator 206A–A to 206N–X is connected to an input of a power combiner 208A–X. Each power combiner combines the input signals to form a single output signal. The output of each power combiner is input to a power amplifier 210A–X, which amplifies the signal and outputs the amplified signal to an antenna element 212A–X.

Modular antenna assemblies for receiving antennas and for transmit/receive antennas are also known. For example, in a receiving antenna, signals are received by antenna elements and input to amplifiers, such as low noise amplifiers. The output signals from the amplifiers are input to power dividers. Each power divider divides the input signal into a plurality of signals of nominally equal power, which are output from the plurality of outputs of power dividers to the input of a corresponding phase shifter attenuator. Each phase shifter attenuator shifts its input signal by a predetermined phase angle and attenuates the input signal by a predetermined amount. The phase angles and attenuation amounts may be different for each phase shifter attenuator. The output of each phase shifter attenuator is connected to an input of a power combiner. Each power combiner combines the input signals to form a single output signal which is input to an amplifier, which amplifies the signal and outputs the amplified signal.

As another example, in a transmit/receive antenna, the Low Noise Amplifiers (LNAs) of the receive example and the power amplifiers of the transmit example are replaced by duplexed amplifier pairs. Each duplexed amplifier pair includes a power amplifier and an LNA connected between a pair of duplexers. By controlling the operation of the duplexers, the system may be operated in either transmit or receive mode as desired, as is well known to those of skill in the art. The duplexers may be implemented as switches or circulators Electromagnetic coupling among the circuit paths of an antenna array module cause coupling of the beam signal on each circuit path to the circuit paths of every other beam signal in the antenna array module. This coupling effect is typically dependent upon the geometry and layout of the circuit paths in the antenna array module, with (in general) greater coupling occurring among circuit paths that are physically closer to each other and that are parallel to each other. A signal that is introduced due to electromagnetic coupling may be seen as an error signal introduced into the intended signal.

Due to the regular geometry of antenna array modules, the coupling of beam signals will tend to correlate from module to module. Since the antenna array modules are typically mass-produced, the coupling among signals in each antenna array module will be similar. Thus, the magnitude and phase of the coupling is repeatable from module to module. These correlated, coupled signals reinforce each other and produce a much greater error signal in each beam than would be produced by any one uncorrelated signal. The beam pattern for each beam signal will be the vector sum of the intended beam pattern for the beam signal and the intended beam pattern for each other beam signal path that receives power from the first beam signal by unintended coupling, attenuated by the isolation of the coupling path. Each coupled error signal will create a sidelobe in the beam pattern of the beam associated with that signal in the direction of the mainlobe of the intended beam pattern of the beam into which the signal has coupled. This may cause unacceptable interference.

Figure 3:
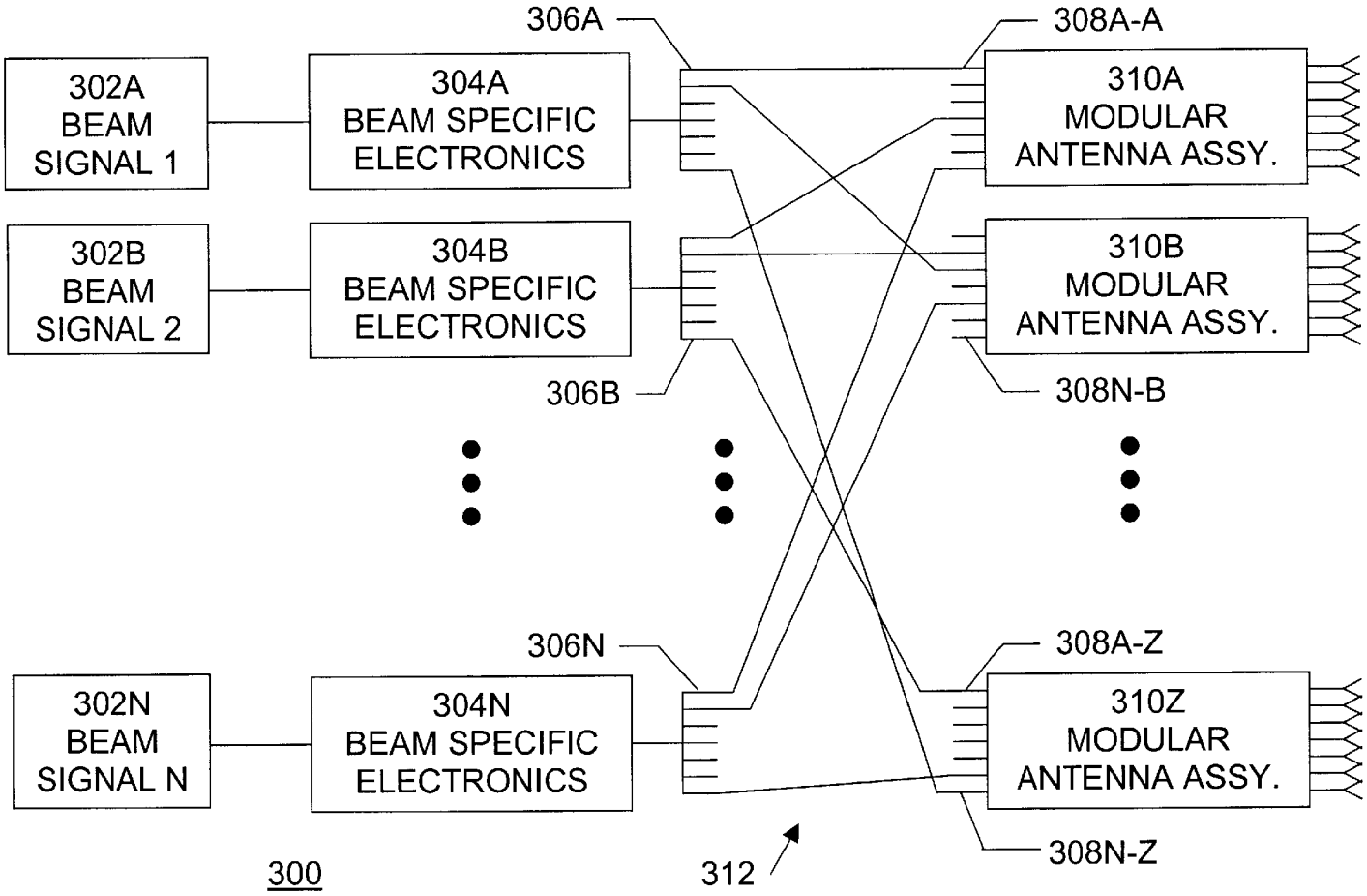
FIG. 3 is an exemplary block diagram of modular phased array antenna, according to the present invention.

An exemplary block diagram of modular phased array antenna 300, according to the present invention, is shown in FIG. 3. Modular phased array antenna 300 creates a plurality of beams. Each beam is associated with a signal such as beam signals 302A–N. Each of these beam signals are intended to be directed in a particular direction by modular phased array antenna 300. In an embodiment in which modular phased array antenna 300 is a transmitting antenna, each beam is radiated in a particular direction. In an embodiment in which modular phased array antenna 300 is a receiving antenna, each beam is received from a particular direction.

Each beam signal is processed by beam specific electronics. For example, beam signal 302A is processed by beam specific electronics 304A, beam signal 302B is processed by beam specific electronics 304B, etc. In an embodiment in which modular phased array antenna 300 is a transmitting antenna, each beam signal is input to beam specific electronics. In an embodiment in which modular phased array antenna 300 is a receiving antenna, each beam signal is output from beam specific electronics. Beam specific electronics includes such functions as amplification/attenuation, frequency conversion and filtering.

The beam specific electronics 304A–N is connected to power dividers/combiners 306A–N, which are connected to beam ports 308AA–NZ of modular antenna assemblies 310A–Z. In the present invention, the connections 312 between the power dividers/combiners 306A–N and the modular antenna assemblies 310A–Z are not regular. That is, each power divider/combiner is not connected to the same beam port of each modular antenna assembly. Preferably, the connections 312 between the power dividers/combiners 306A–N and the beam ports 308A–Z of modular antenna assemblies 310A–Z are connected so that the sum of coupling coefficients of beam signal to beamformer paths are reduced or minimized, or the connections are randomized. The non-regular connections between the power dividers/combiners 306A–N and the beam ports 308A–Z of modular antenna assemblies 310A–Z breaks up the array level correlation of the electromagnetic coupling paths among modular antenna assemblies 310A–Z. Since the electromagnetic coupling paths are not correlated at the array level, the coupled signals do not reinforce each other and thus produce a much smaller degradation in each beam than would be produced by the prior art.

The beam pattern for each beam is the vector sum of the beam pattern of that beam created by each modular antenna assembly. The beam pattern of each modular antenna assembly is the vector sum of the intended beam pattern for the beam and the intended beam pattern for each other beam attenuated/phase shifted by the (vector) coupling factor between the two beam paths within the modular antenna assembly. Because the signal to beam port connections are irregular across the modular antenna assemblies, the direction of the beam mainlobes associated with each modular antenna assembly beam port are also irregular. So the resulting beam patterns associated with a specific signal (including the effects of finite isolation) of the modular antenna assemblies are all different. In particular the sidelobes created by finite isolation are in different directions. When the beam pattern of the whole array is formed, for a particular signal, by summing the beam patterns of the modular antenna assemblies, the sidelobes created by the finite isolation effect are substantially lower than would be the case for a prior art antenna.

Figure 7:
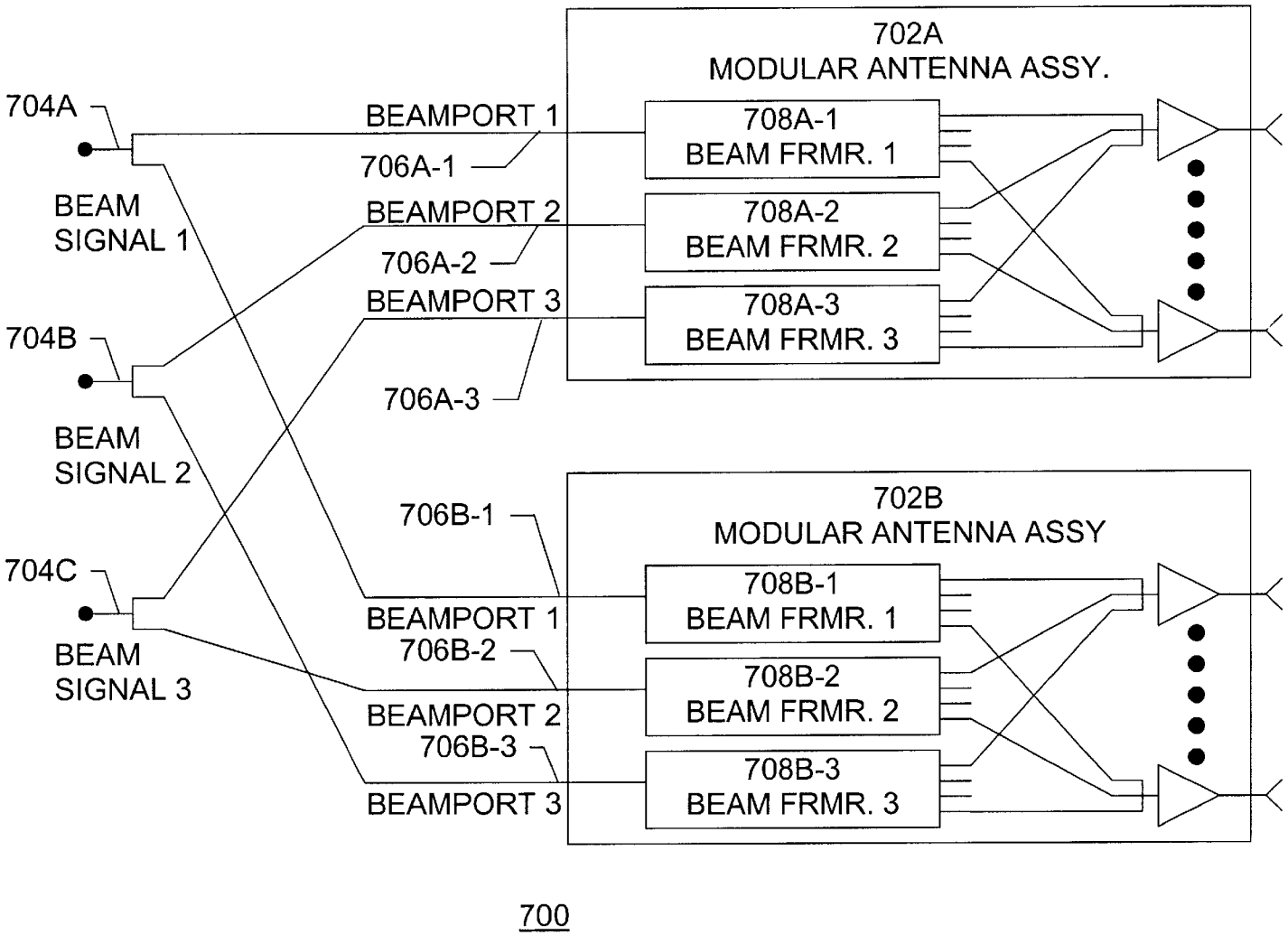
FIG. 7 is an exemplary block diagram of a modular array antenna.

The mechanism for achieving improved sidelobes is described above for the general case. Referring to FIG. 7, an exemplary modular array antenna 700 is illustrated. The example shown in FIG. 7 is a three beam modular array antenna including two modular antenna assemblies 702A and 702B. In this example it is arbitrarily assumed that the three beams are intended to point 0,+0.2 and −0.3 radians from the antenna boresight. These directions apply to beam signals 704A, 704B, and 704C respectively. It is assumed that the coupling factor from beam port 706A-1 to beamformer 708A-2 of modular antenna assembly 702A and beam port 706B-1 to beamformer 708B-2 of modular antenna assembly 702B within the modular antenna assembly is −10 dB and that the coupling factor from beam port 706A-1 to beamformer 708A-3 of modular antenna assembly 702A and beam port 706B-1 to beamformer 708B-3 of modular antenna assembly 702B within the modular antenna assembly is −20 dB. It is also assumed that beam signal 704A is applied to beam port 706A-1 of modular antenna assembly 702A and beam port 706B-1 of modular antenna assembly 702B. It is further assumed that beam signal 704B is applied to beam port 706A-2 of modular antenna assembly 702A and beam port 706B-3 of modular antenna assembly 702B. It is assumed that beam signal 704C is applied to beam port 706A-3 of modular antenna assembly 702A and beam port 706B-2 of modular antenna assembly 702B.

Figure 4:
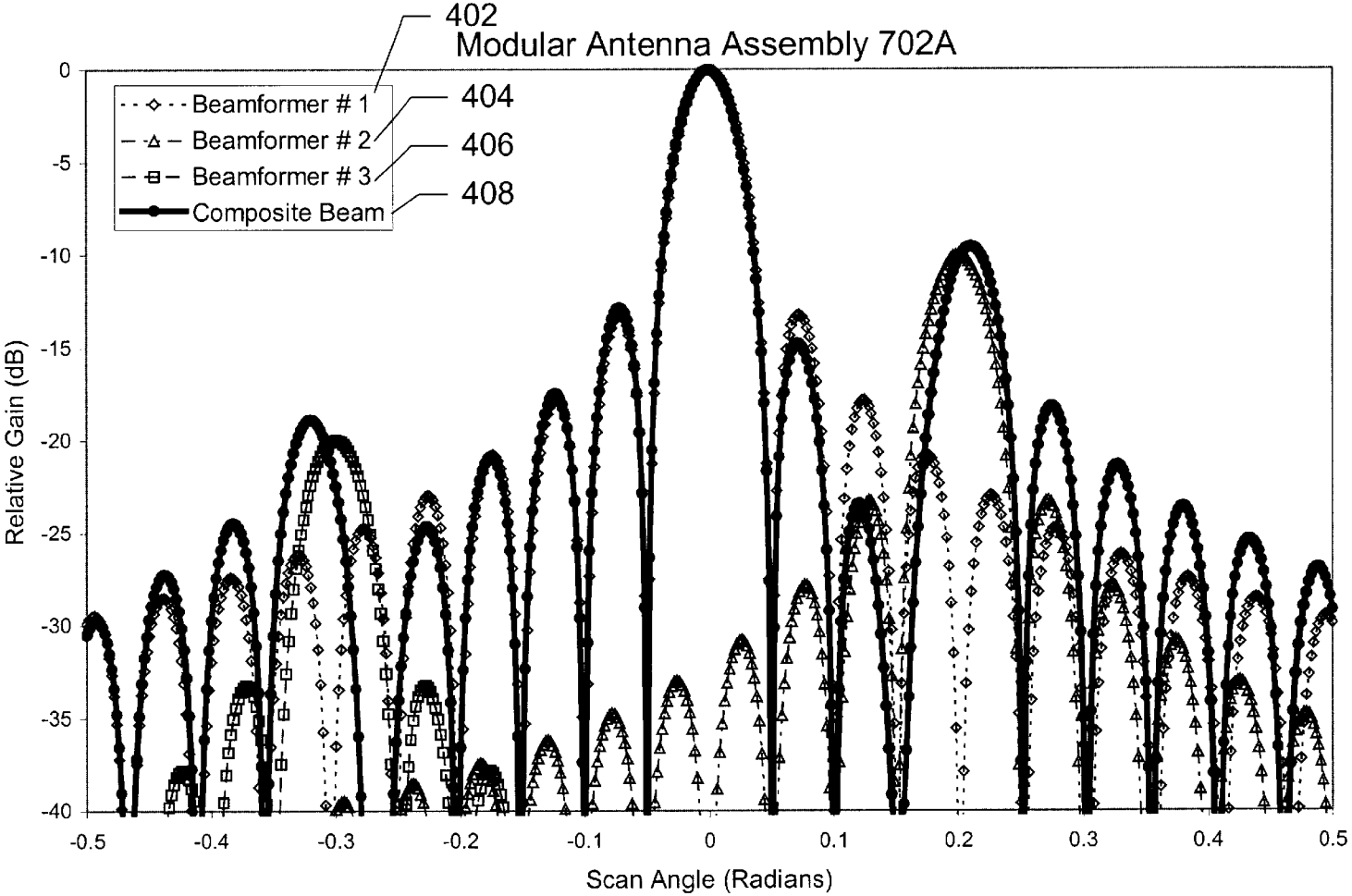
FIG. 4 illustrates an example of a predicted beam pattern for a modular antenna assembly shown in FIG. 7.

Referring now to FIG. 4 in conjunction with FIG. 7, an example of a predicted beam pattern for modular antenna assembly 702A is shown. All four curves contained in this Figure apply to beam signal 704A, which is applied to beam ports 706A-1 and 706B-1. The curve 402 (shown with a dashed line with diamond symbols) is the intended beam pattern for beam signal 704A. This signal flows through beam port 706A-1 and the beamformer 708A-1 path within modular antenna assembly 702A. It can be seen from FIG. 4 that this beam is pointed in the direction of the antenna boresight. The beam plots in FIG. 4 have been normalized so that the peak gain of beam 402 is 0 dB.

Curve 404 in FIG. 4 (shown with a dashed/dot line with triangle symbols) is the beam pattern for the portion of beam signal 704A that flows through beam port 706A1 and then electromagnetically couples into the beamformer 708A-2 path within modular antenna assembly 702A. This beam signal passes through the phase shifters in the beamformer 708A-2 path, which steers the beam to 0.2 radians from boresight. (This is the intended direction for beam signal 704B, which is steered by the beamformer 708A-2 path in modular antenna assembly 702A). The peak antenna gain for this beam is 10 dB lower than the first beam due to the 10 dB coupling factor.

Curve 406 in FIG. 4 (shown with a dashed line with square symbols) is the beam pattern for the portion of beam signal 704A that flows through beam port 706A-1 and then electromagnetically couples into the beamformer 708A-3 path within modular antenna assembly 702A. This beam signal passes through the phase shifters in the beamformer 708A-3 path, which steers the beam to −0.3 radians from boresight. (This is the intended direction for beam signal 704C, which is steered by the beamformer 708A-3 path in modular antenna assembly 702A). The peak antenna gain for this beam is 20 dB lower than the first beam due to the 20 dB coupling factor.

Curve 408 in FIG. 4 (shown with a solid line with circle symbols) is the composite beam pattern associated with beam signal 704A created by modular antenna assembly 702A. It is formed by vector summing curves 402, 404, and 406. It can be seen that this beam pattern has a primary lobe at boresight and a large sidelobe at ~0.2 radians.

Figure 5:
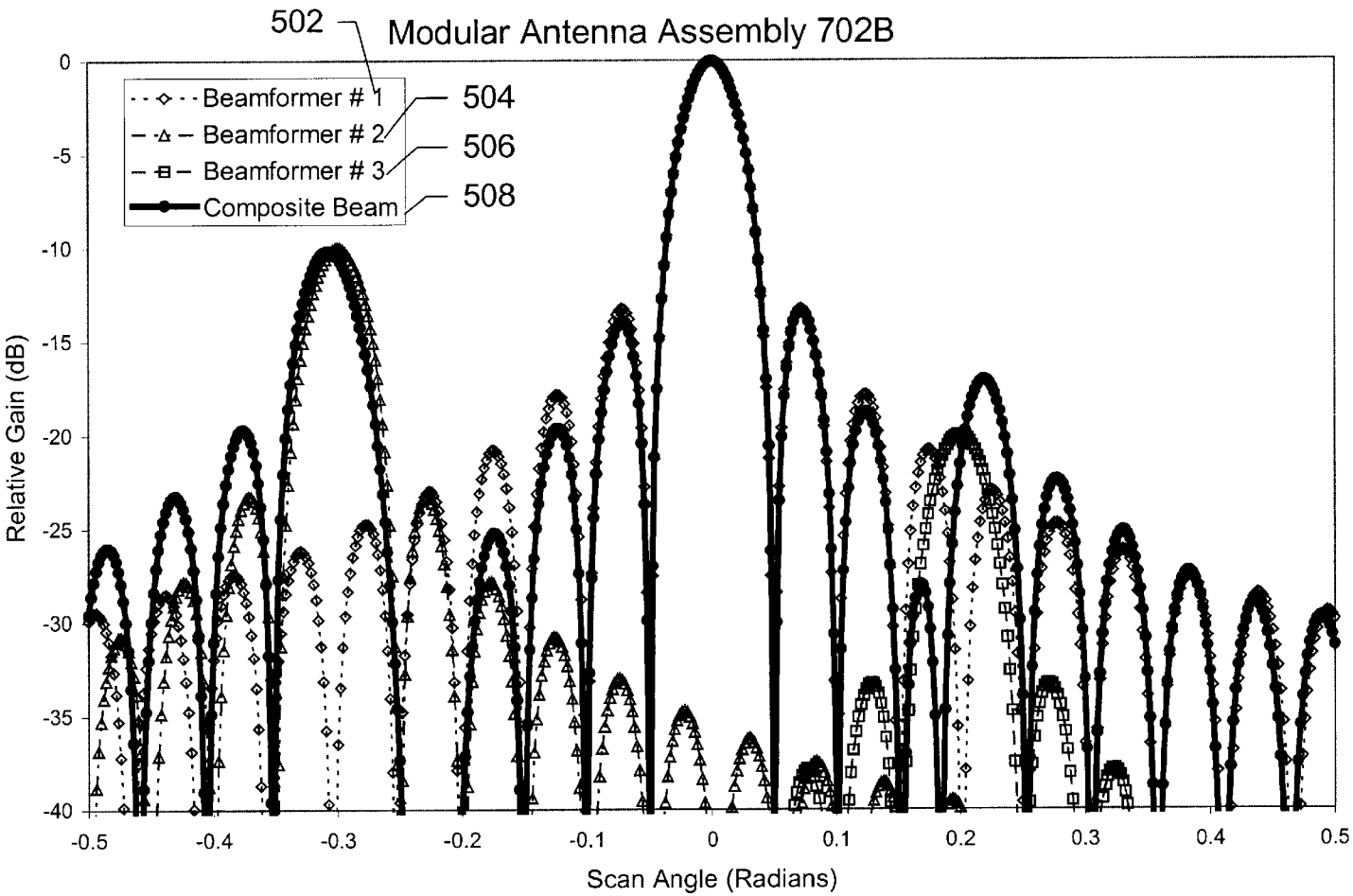
FIG. 5 illustrates an example of a predicted beam pattern for a modular antenna assembly shown in FIG. 7.

Referring now to FIG. 5 in conjunction with FIG. 7, an example of a predicted beam pattern for modular antenna assembly 702B is shown. All four curves 502-508 shown in FIG. 5 apply to beam signal 704A, which is applied to beam ports 706A-1 and 706B-1. Curve 502 (shown with a dashed line with diamond symbols) is the intended beam pattern for beam signal 704A. This signal flows through beam port 706B-1 and the beamformer 708B-1 path within modular antenna assembly 702B. It can be seen from FIG. 5 that this beam is pointed in the direction of the antenna boresight. The beam plots in FIG. 5 have been normalized so that the peak gain of this beam is 0 dB.

Curve 504 in FIG. 5 (shown with a dashed/dot line with triangle symbols) is the beam pattern for the portion of beam signal 704A that flows through beam port 706B-1 and then electromagnetically couples into the beamformer 708B-2 path within modular antenna assembly 702B. This beam signal passes through the phase shifters in the beamformer 708B-2 path, which steers the beam to −0.3 radians from boresight. (This is the intended direction for beam signal 704C, which is steered by the beamformer 708B-2 path in modular antenna assembly 702B). The peak antenna gain for this beam is 10 dB lower than the first beam due to the 10 dB coupling factor.

Curve 506 in FIG. 5 (shown with a dashed line with square symbols) is the beam pattern for the portion of beam signal 704A that flows through beam port 706B-1 and then electromagnetically couples into the beamformer 708B-3 path within modular antenna assembly 702B. This beam signal passes through the phase shifters in the beamformer 708B-3 path, which steers the beam to 0.2 radians from boresight. (This is the intended direction for beam signal 704B, which is steered by the beamformer 708B-3 path in modular antenna assembly 702B). The peak antenna gain for this beam is 20 dB lower than the first beam due to the 20 dB coupling factor.

Curve 508 (shown with a solid line with circle symbols) is the composite beam pattern associated with beam signal 704A created by modular antenna assembly 702B. It is formed by vector summing curves 502, 504 and 506. It can be seen that this beam pattern has primary lobe at boresight and a large sidelobe at ~−0.3 radians.

Figure 6:
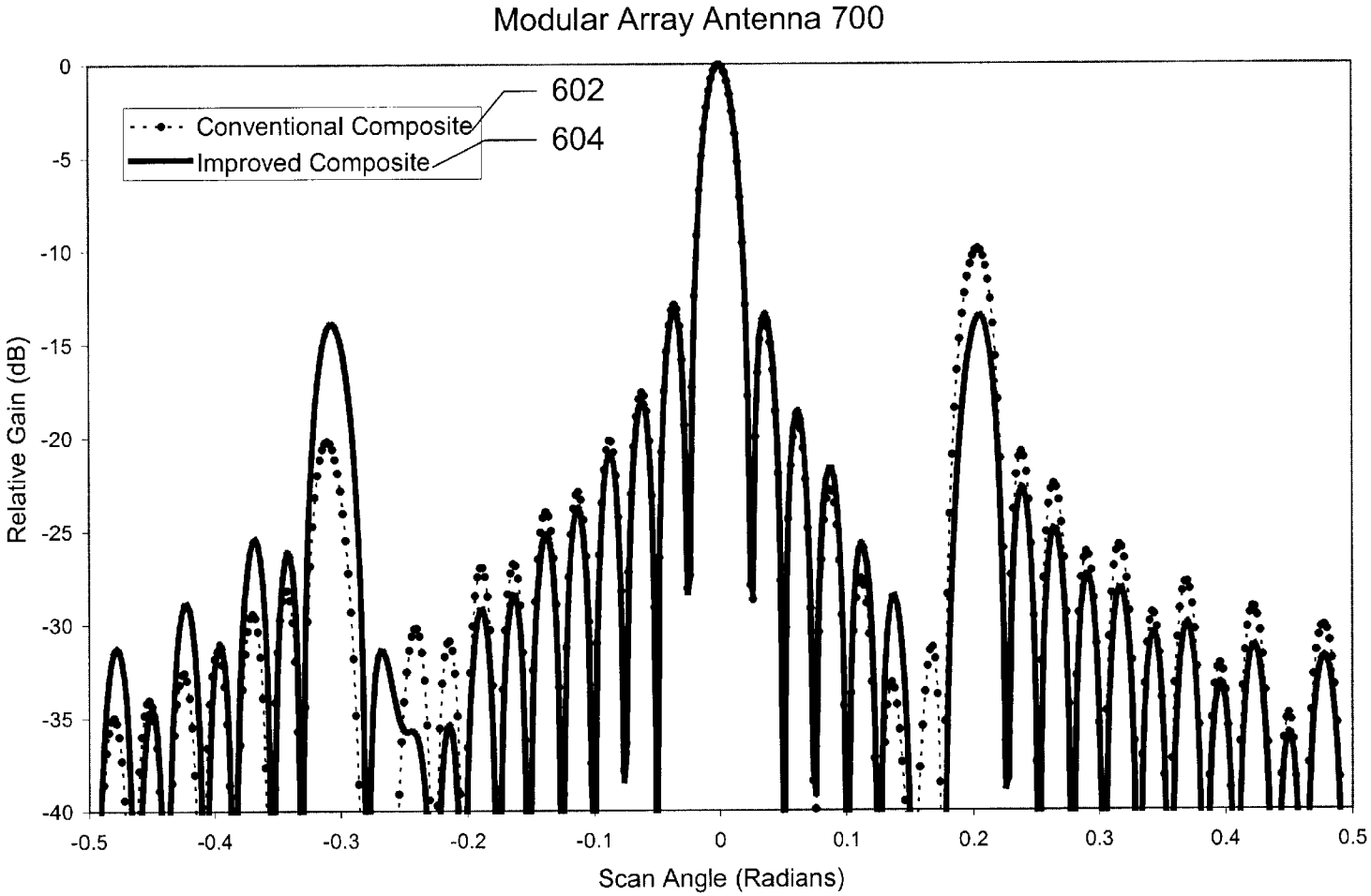
FIG. 6 illustrates an example of a composite beam pattern for a modular array antenna shown in FIG. 7.

Referring now to FIG. 6 in conjunction with FIG. 7, an example of a composite beam pattern for beam signal 704A for an antenna including modular antenna assembly 702A and modular antenna assembly 702B is shown. Curve 602 (dashed line with circular symbols) shows the beam pattern with a conventional array architecture (for example with beam signal 704A connected to beam ports 706A-1 and 706B-1, beam signal 704B connected to beam ports 706A-2 and 706B-2, and beam signal 704C connected to beam ports 706A-3 and 706B-3. It can be seen that this configuration results in a worst case sidelobe of ~−10 dB.

Curve 604 (heavy solid line) shows the beam pattern with the antenna array architecture of the present invention. In this case, the beam signal to beam port assignments are shown in FIG. 7. It can be seen that the worst case sidelobe is ~−13.5 dB. This is 3.5 dB better than for the conventional architecture. In general, the achievable improvement in the worst case sidelobe level is roughly equal to the number of modular antenna assemblies in the antenna array. So a practical antenna array with many more than two modular antenna assemblies will have a significantly larger improvement in the worst case sidelobe level.

For an antenna array containing many modular antenna assemblies it is desired to select the signal to beam port assignments so that the sum of the coupling factors is reduced or minimized. If there are N beams, each beam will have N−1 sidelobes created by finite isolation effects. These sidelobes are pointed in the direction of the other N−1 beams. So there are a total of N*(N−1) sidelobes created by finite isolation effects. The magnitude of each of these sidelobes will be determined by the vector sum of Z coupling coefficients, where Z is the number of modular antenna assemblies in the complete antenna.

To minimize the magnitude of the sidelobes created by finite isolation, it is necessary to optimize the signal to beam port assignments across the array so that all of the vector sums of the N*(N−1) sets of Z coupling coefficients are minimized. For a large array, a random assignment of signal/beam port assignments is likely to be a good approximation to the optimum solution. In general it is important to minimize repetition/patterns of signal to beam port assignments from modular antenna assembly to modular antenna assembly. For example if Signals 1, 2 and 3 are assigned to beam ports 1, 2 and 3 of a modular antenna assembly respectively, it is not good to also assign the same signals to the same beam ports of any other modular antenna assembly. Repeating or regular patterns result in the same coupling coefficient appearing more than once in a set Z coefficients which are added to determine the magnitude of a particular sidelobe. This is likely to increase the magnitude of the sidelobe. Statistically it is more likely that the sum of Z vectors will be smaller if the vectors are all different. If, for example, all the vectors have the same magnitude but random phases, the expected value of the magnitude of the sum of Z randomly selected vectors will be $\sqrt{Z}$ times larger than the magnitude of one vector. In the extreme case where all the vectors are the same (which is analogous to the prior art) the magnitude is Z times larger than the magnitude of one vector.

In a practical application it is likely that a small number of the coupling coefficients will be much larger than the rest. In this case it is important to carefully select the signal to beam port assignments to minimize sidelobes resulting from these stronger coupling paths. (i.e. minimize repeating patterns for these port combinations). The signal to beam port assignments for beam port pairs with good isolation/low coupling is much less important.

Since the worst case sidelobes resulting from finite isolation are much smaller than in the prior art, the requirements for the isolation of the coupling path may be relaxed. In particular, the isolation requirement may be relaxed by a factor roughly equal to the number of modular antenna assemblies. For example, a typical antenna array may have approximately 20 to 30 modular antenna assemblies. Thus, according to the present invention, the isolation requirement for such an array may be relaxed by approximately 13 to 15 dB. Alternatively, for the same isolation of the coupling path, the coupled error signals will be reduced by approximately 13 to 15 dB. Likewise, one of skill in the art would recognize that any combination of relaxation of the isolation requirement and/or reduction in coupled error signals within the range of approximately 13 to 15 dB may be achieved.

In an embodiment in which modular phased array antenna 300 is a transmitting antenna, each signal that is output from the beam specific electronics is divided by a power divider having one output connected to one beam port of each modular antenna assembly. Thus, in the example shown in FIG. 3, each output from power divider 306A is connected to an input beam port of each modular antenna assembly, each output from power divider 306B is connected to an input beam port of each modular antenna assembly, etc. The connections from the power dividers to the inputs of the modular antenna assemblies are not regular, and preferably are connected so that the sum of coupling coefficients of beam signal to beamformer paths are reduced or minimized, or the connections are randomized.

In an embodiment in which modular phased array antenna 300 is a receiving antenna, each signal that is input to the beam specific electronics is output from a power combiner having one input connected to one beam port of each modular antenna assembly. Thus, in the example shown in FIG. 3, each input to power combiner 306A is connected to an output beam port of each modular antenna assembly, each input to power combiner 306B is connected to an output beam port of each modular antenna assembly, etc. The connections from the power combiners to the outputs of the modular antenna assemblies are not regular, and preferably are connected so that the sum of coupling coefficients of beam signal to beamformer paths are reduced or minimized, or the connections are randomized.

The connections from the power dividers/combiners to the inputs/outputs of the modular antenna assemblies may be accomplished in a number of ways. For example, the connections may be "hard-wired" using fiber optic cable, coaxial cable, printed circuit board traces, or other suitable connection technology. Likewise, the phase shifts and attenuations provided by the phase shift attenuators may be provided by installation of appropriately valued fixed components or by appropriate adjustment of variable components. As another example, the connections may be configured in software, which controls a switching matrix or other programmable connection device. Likewise, the phase shifts and attenuations provided by the phase shift attenuators may be provided by appropriate configuration of programmable components. Regardless of the connection technology, the system that controls the operation of the antenna array must be aware of the particular connections from the power dividers/combiners to the inputs/outputs of the modular antenna assemblies that are present and must configure and control the associated circuitry as necessary.

One of skill in the art would recognize that the present invention may also be advantageously applied to a transmit/receive embodiment. This implementation is of interest for radar and half-duplex communications applications. This embodiment is similar to that shown in FIG. 3. However the Low Noise Amplifiers (LNAs) of the receive embodiment and the power amplifiers of the transmit embodiment are replaced by duplexed amplifier pairs. Each duplexed amplifier pair includes a power amplifier and an LNA connected between a pair of duplexers. By controlling the operation of the duplexers, the system may be operated in either transmit or receive mode as desired, as is well known to those of skill in the art. The duplexers may be implemented as switches or circulators. According to the present invention, the connections from the power dividers/combiners to the inputs/outputs of the modular antenna assemblies are not regular, and preferably are connected so that the sum of coupling coefficients of beam signal to beamformer paths are reduced or minimized, or the connections are randomized.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A modular phased array antenna comprising:

a plurality of modular antenna assemblies, each modular antenna assembly having a plurality of beam ports, each beam port of a modular antenna assembly connected to a different beam signal, wherein the beam signals are irregularly connected to the beam ports relative to the modular antenna assemblies.

2. The modular phased array antenna of claim 1, wherein the beam signals are randomly connected to the beam ports relative to the modular antenna assemblies.

3. The modular phased array antenna of claim 1, wherein the beam signals are connected to the beam ports relative to the modular antenna assemblies so that vector sums of coupling coefficients of beam signal to beamformer paths is reduced compared to a regular connection of the beam signals to the beam ports relative to the modular antenna assemblies.

4. The modular phased array antenna of claim 1, wherein the beam signals are connected to the beam ports relative to the modular antenna assemblies so that vector sums of coupling coefficients of beam signal to beamformer paths is minimized.

5. The modular phased array antenna of claim 1, wherein the modular phased array antenna is a receiving antenna.

6. The modular phased array antenna of claim 5, wherein each modular antenna assembly comprises:

a plurality of power combiners, each power combiner having an output connected to a beam port of the modular antenna assembly, and each power combiner having a plurality of inputs;

a plurality of phase shift attenuators, each phase shift attenuator having an output connected to an input of a power combiner, and each phase shift attenuator having an input;

a plurality of power dividers, each power divider having a plurality of outputs, each output connected to an input of a phase shift attenuator, and each power divider having an input;

a plurality of amplifiers, each amplifier having an output connected to an input of a power divider, and each amplifier having an input; and a plurality of antenna elements, each antenna element having an output connected to an input of an amplifier.

7. The modular phased array antenna of claim 6, further comprising:

a plurality of driver amplifiers, each driver amplifier connected between a beam port of the modular antenna assembly and a power combiner output, each driver amplifier having an input connected to a power combiner output and having an output connected to a beam port.

8. The modular phased array antenna of claim 6, further comprising:

a plurality of power combiners, each power combiner having an output connected to a beam signal and having a plurality of inputs receiving the beam signal, each of the plurality of inputs connected to a beam port of a modular antenna assembly.

9. The modular phased array antenna of claim 8, wherein the connections of the beam signals to the beam ports of the modular antenna assemblies are randomly assigned.

10. The modular phased array antenna of claim 8, wherein the connections of the beam signals to the beam ports of the modular antenna assemblies are assigned so that vector sums of coupling coefficients of beam signal to beamformer paths is reduced compared to a regular connection of the beam signals to the beam ports relative to the modular antenna assemblies.

11. The modular phased array antenna of claim 8, wherein the connections of the beam signals to the beam ports of the modular antenna assemblies are assigned so that vector sums of coupling coefficients of beam signal to beamformer paths is minimized.

12. The modular phased array antenna of claim 8, wherein the connections of the beam signals to the beam ports of the modular antenna assemblies are hard-wired.

13. The modular phased array antenna of claim 8, wherein the connections of the beam signals to the beam ports of the modular antenna assemblies is provided by at least one of fiber optic cable, coaxial cable, or printed circuit board traces.

14. The modular phased array antenna of claim 8, wherein the connections of the beam signals to the beam ports of the modular antenna assemblies is configurable in software.

15. The modular phased array antenna of claim 8, wherein the connections of the beam signals to the beam ports of the modular antenna assemblies is provided by a switching matrix or other programmable connection device.

16. The modular phased array antenna of claim 1, wherein the modular phased array antenna is a transmitting antenna.

17. The modular phased array antenna of claim 16, wherein each modular antenna assembly comprises:

a plurality of power dividers, each power dividers having an input connected to a beam port of the modular antenna assembly, and each power divider having a plurality of outputs;

a plurality of phase shift attenuators, each phase shift attenuator having an input connected to an output of a power divider, and each phase shift attenuator having an output;

a plurality of power combiners, each power combiner having a plurality of inputs, each input connected to an output of a phase shift attenuator, and each power combiner having an output;

a plurality of amplifiers, each amplifier having an input connected to an output of a power combiner, and each amplifier having an output; and a plurality of antenna elements, each antenna element having an input connected to an output of an amplifier.

18. The modular phased array antenna of claim 17, further comprising:

a plurality of driver amplifiers, each driver amplifier connected between a beam port of the modular antenna assembly and a power divider input, each driver amplifier having an input connected to a beam port and having an output connected to a power divider input.

19. The modular phased array antenna of claim 17, further comprising:

a plurality of power dividers, each power divider having an input connected to a beam signal and having a plurality of outputs outputting the beam signal, each of the plurality of outputs connected to a beam port of a modular antenna assembly.

20. The modular phased array antenna of claim 19, wherein the connections of the beam signals to the beam ports of the modular antenna assemblies are randomly assigned.

21. The modular phased array antenna of claim 19, wherein the connections of the beam signals to the beam ports of the modular antenna assemblies are assigned so that vector sums of coupling coefficients of beam signal to beamformer paths is reduced compared to a regular connection of the beam signals to the beam ports relative to the modular antenna assemblies.

22. The modular phased array antenna of claim 19, wherein the connections of the beam signals to the beam ports of the modular antenna assemblies are assigned so that vector sums of coupling coefficients of beam signal to beamformer paths is minimized.

23. The modular phased array antenna of claim 19, wherein the connections of the beam signals to the beam ports of the modular antenna assemblies are hard-wired.

24. The modular phased array antenna of claim 19, wherein the connections of the beam signals to the beam ports of the modular antenna assemblies is provided by at least one of fiber optic cable, coaxial cable, or printed circuit board traces.

25. The modular phased array antenna of claim 19, wherein the connections of the beam signals to the beam ports of the modular antenna assemblies is configurable in software.

26. The modular phased array antenna of claim 19, wherein the connections of the beam signals to the beam ports of the modular antenna assemblies is provided by a switching matrix or other programmable connection device.

27. The modular phased array antenna of claim 1, wherein the modular phased array antenna is a transmitting and receiving antenna.

28. The modular phased array antenna of claim 27, wherein each modular antenna assembly comprises:

a plurality of first power dividers/combiners, each first power divider/combiner having a first input/output connected to a beam port of the modular antenna assembly, and each first power divider/combiner having a plurality of second outputs/inputs;

a plurality of phase shift attenuators, each phase shift attenuator having a first input/output connected to a second output/input of a first power divider/combiner, and each phase shift attenuator having a second output/input;

a plurality of second power combiners/dividers, each second power combiner/divider having a plurality of first inputs/outputs, each first input/output connected to a second output/input of a phase shift attenuator, and each second power combiner/divider having a second output/input;

a plurality of duplexed amplifier pairs, each duplexed amplifier pair comprising a first amplifier and a second amplifier connected between a pair of duplexers, each duplexed amplifier pair having a first input/output connected to second output/input of a second power combiner/divider, and each amplifier having a second output/input; and a plurality of antenna elements, each antenna element having an input/output connected to a second output/input of a duplexed amplifier pair.

29. The modular phased array antenna of claim 28, further comprising:

a plurality of duplexed driver amplifier pairs, each duplexed driver amplifier pair connected between a beam port of the modular antenna assembly and a power divider/combiner input/output, each duplexed amplifier pair comprising a first driver amplifier arid a second driver amplifier connected between a pair of duplexers, each duplexed driver amplifier pair having a first input/output connected to a beam port of the modular antenna assembly, and having a second output/input connected to a power divider/combiner input/output.

30. The modular phased array antenna of claim 28, further comprising:

a plurality of third power dividers/combiners, each third power divider/combiner having a first input/output connected to a beam signal and having a plurality of second outputs/inputs connected to a beam port of a modular antenna assembly.

31. The modular phased array antenna of claim 30, wherein the connections of the beam signals to the beam ports of the modular antenna assemblies are randomly assigned.

32. The modular phased array antenna of claim 30, wherein the connections of the beam signals to the beam ports of the modular antenna assemblies are assigned so that vector sums of coupling coefficients of beam signal to beamformer paths is reduced compared to a regular connection of the beam signals to the beam ports relative to the modular antenna assemblies.

33. The modular phased array antenna of claim 30, wherein the connections of the beam signals to the beam ports of the modular antenna assemblies are assigned so that vector sums of coupling coefficients of beam signal to beamformer paths is minimized.

34. The modular phased array antenna of claim 30, wherein the connections of the beam signals to the beam ports of the modular antenna assemblies are hard-wired.

35. The modular phased array antenna of claim 30, wherein the connections of the beam signals to the beam ports of the modular antenna assemblies is provided by at least one of fiber optic cable, coaxial cable, or printed circuit board traces.

36. The modular phased array antenna of claim 30, wherein the connections of the beam signals to the beam ports of the modular antenna assemblies is configurable in software.

37. The modular phased array antenna of claim 30, wherein the connections of the beam signals to the beam ports of the modular antenna assemblies is provided by a switching matrix or other programmable connection device.

* * * * *

UNITED STATES PATENT AND TRADEMARK OFFICE

CERTIFICATE OF CORRECTION

PATENT NO. : 6,738,017 B2
DATED : May 18, 2004
INVENTOR(S) : Anthony W. Jacomb-Hood It is certified that error appears in the above-identified patent and that said Letters Patent is hereby corrected as shown below:

Column 15,
Line 36, "arid" should read -- and --.

Signed and Sealed this

Twenty-seventh Day of July, 2004

JON W. DUDAS
*Acting Director of the United States Patent and Trademark Office*